United States Patent [19]

Ewing et al.

[11] 4,148,418

[45] Apr. 10, 1979

[54] DISPENSER FOR CARTONS

[76] Inventors: Gary B. Ewing, 1731 Meadow Moor Rd.; Wayne A. Provost, P.O. Box 17022, both of Salt Lake City, Utah 84117

[21] Appl. No.: 730,576

[22] Filed: Oct. 7, 1976

[51] Int. Cl.[2] ..... B67D 5/06

[52] U.S. Cl. ..... 222/183; 220/85 H

[58] Field of Search ..... 222/173, 183, 465, 475, 222/469, 470, 472, 531, 533, 525, 556; 220/85 H, 306; 229/14 BE; 215/100 R, 100 A

[56] References Cited

U.S. PATENT DOCUMENTS

| | | | |
|---|---|---|---|
| 2,600,911 | 6/1952 | Olson | 222/183 |
| 2,906,439 | 9/1959 | Santuci | 222/183 |
| 3,203,598 | 8/1965 | Alford | 222/183 |
| 3,254,811 | 6/1966 | Harris | 222/556 |
| 3,499,588 | 3/1970 | Bartilson et al. | 222/556 |
| 3,738,529 | 6/1973 | Rose | 220/85 H |

*Primary Examiner*—Stanley H. Tollberg
*Assistant Examiner*—H. Grant Skaggs
*Attorney, Agent, or Firm*—B. Deon Criddle

[57] ABSTRACT

A low cost dispenser that will accommodate cereal packages and the like, to allow the packages to be repeatedly sealed so as to prevent spillage and to retain the freshness of the contents, even after the packages have been opened to permit discharge of the contents.

4 Claims, 3 Drawing Figures

DISPENSER FOR CARTONS

BRIEF DESCRIPTION OF THE INVENTION

1. Field of the Invention

This invention relates to devices for containing cereal boxes and the like, to give them rigidity during handling and to protect the contents of the carton against spillage and spoilage.

2. Prior Art

Various kinds of containers and holders have been proposed in the past for dispensing cartons, such as are commonly used for cereal, milk and the like. These containers and holders, while providing rigidity and facilitating the handling of the cartons and generally preventing spillage and reducing spoilage, are cumbersome to use and cannot be produced economically enough to make them widely accepted.

SUMMARY OF THE INVENTION

Principal objects of the present invention are to provide a dispenser for use with cereal cartons and the like that is inexpensively constructed, but that will provide desired rigidity in the handling of the carton, long life, easy insertion of the carton into the dispenser and easy dispensing of product from the carton.

Principal features of the invention include an open and somewhat resilient bottom frame, a top frame, with a rigid top surface and a pivoted discharge door, and a strut interconnecting the top and bottom frames. Lugs on the inside of the bottom frame allow a carton to be easily inserted upwardly through the frame but resist movement of the carton out of the dispenser through the bottom frame.

Further objects and features of the invention will become apparent from the following detailed description, taken together with the accompanying drawing, disclosing what is presently contemplated as being the best mode of the invention.

THE DRAWING

In the drawing:

FIG. 1 is a perspective view of the dispenser of the invention with a carton inserted therein;

FIG. 2, a vertical section view, taken on the line 2—2 of FIG. 1; and

FIG. 3, an enlarged, fragmentary view, taken on the line 3—3 of FIG. 1.

DETAILED DESCRIPTION

Figure 1:
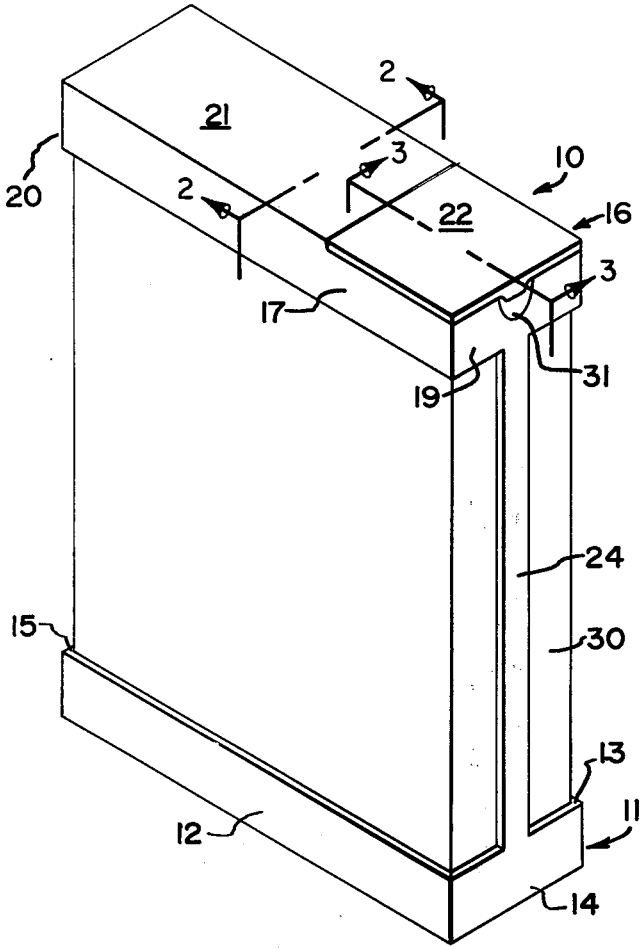

Referring now to the drawing:

In the illustrated preferred embodiment, the dispenser of the invention is shown generally at 10.

Dispenser 10 includes a bottom frame 11 made up of somewhat resilient side members 12 and 13 and end members 14 and 15 and a top frame 16. The top frame is formed with side members 17 and 18 interconnected at opposite end members 19 and 20 and with a top wall 21 interconnecting portions of the side members with the end member 19.

A flap 22 is hingedly connected at 23 to the top wall 21 and is adapted to overlie the lengths of the said members 17 and 18 not interconnected by the top wall, and the end member 19. The flap 22 thus serves as a lid through which food material may be dispensed, as will be hereinafter further described.

The end member 14 of bottom frame 11 and the end members 19 of top frame 16 are centrally interconnected by a member 24, and the end members 15 and 20 are similarly centrally interconnected by members 25.

Figure 2:
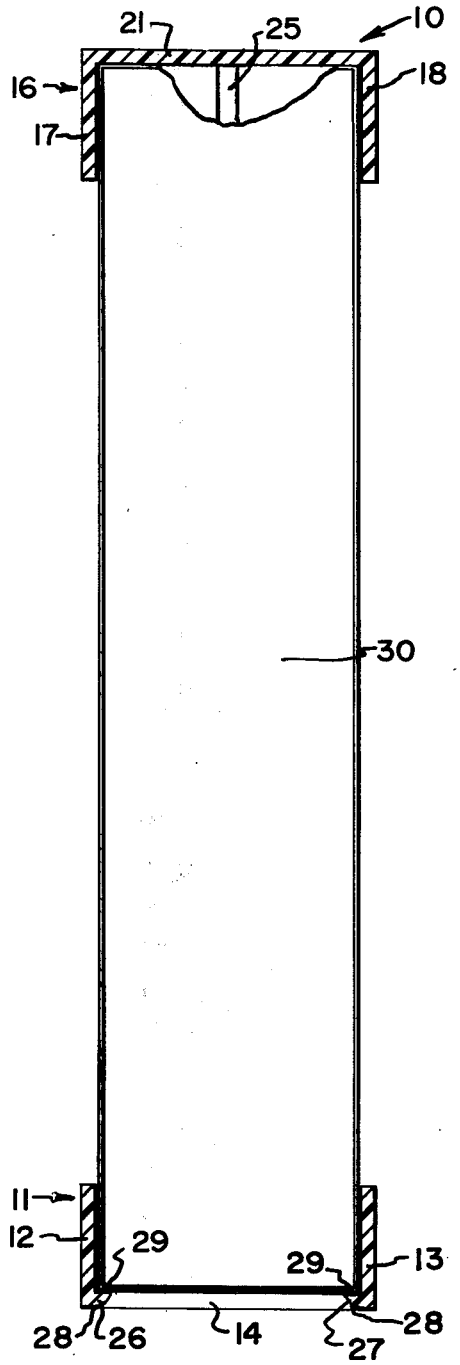
Figure 3:
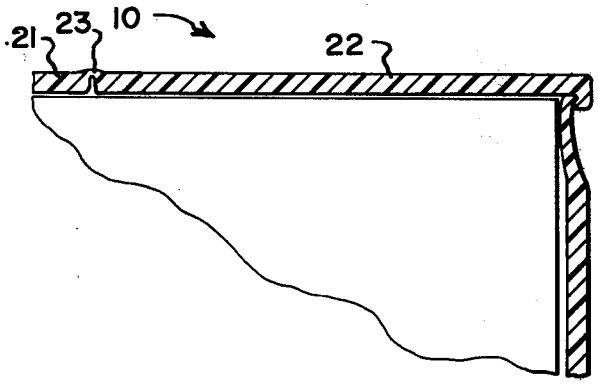

Lugs 26 and 27 (FIG. 2), are respectively provided to project inwardly from the somewhat resilient side members 12 and 13. Each lug includes a bottom cam surface 28 that extends upwardly and inwardly of the bottom edge of the side member and an abrupt upper surface 29.

In use, a carton 30 containing cereal or other material to be dispensed, is positioned within the dispenser by pushing it upwardly against the surfaces 28 of the lugs 26 and 27. This upward pressure deforms the side members 12 and 13 and allows the carton to be passed upwardly past the lugs, until the lugs snap beneath the bottom of the carton. The relative sizes of the components of the dispenser 10 may be varied to accommodate different sizes of cartons. In general, however, each dispenser will be used with a carton that will fit snugly therein, with the bottom of the carton resting on the lugs 26 and 27 when the top of the carton is flush against the top wall 21. The top of the carton beneath the flap 22 is opened so that the contents of the container can be poured therethrough and through the flap 22.

With a carton positioned therein the upper frame 11 closely surrounds the upper end of the carton, the lower frame 16 closely surrounds the lower end of the carton and the members 24 and 25 provide rigidity to the dispenser.

A notch 31 may be provided in an upper edge of end member 19 to facilitate grasping and pivoting of the flap 22 to an opened position so that the carton contents may be poured therethrough.

In removing a carton from the dispenser, the user flexes the side members 12 and 13 outwardly until the lugs 26 and 27 are no longer supporting the carton and the carton then falls between the side members.

The dispenser herein described is preferably made of plastic and may be readily formed by ejection molding techniques.

Although a preferred form of our invention has been herein disclosed, it is to be understood that the present disclosure is by way of example and that variations are possible without departing from the subject matter coming within the scope of the following claims, which subject matter we regard as our invention.

We claim:

1. A low cost dispenser comprising an upper frame adapted to receive and closely surround an upper end of a carton, said upper frame including spaced apart side members interconnected by spaced apart end members and a top extending thereover and having a flap formed in the top thereof;

a lower frame adapted to receive and closely surround a lower end of the carton, said lower frame comprising a pair of spaced apart, somewhat resilient side members;

a pair of spaced apart end members interconnecting said side members;

a pair of members, one of which interconnects a pair of end members of the upper and lower frames and the other of which interconnects the other end members of said frames; and a lug fixed to and projecting inwardly from each side member of the lower frame.

2. A low cost dispenser as in claim 1, wherein the lugs having camming surfaces on the bottom thereof extending upwardly and inwardly with respect to said dispenser.

3. A low cost dispenser as in claim 2, wherein the top frame includes a top wall interconnecting and overlying one end member and portions of the side members; and wherein the flap is hingedly connected to the top wall and overlies the portions of the side members not covered by the top flap and the other end member.

4. A low cost dispenser as in claim 3, wherein the lugs have abrupt upper surfaces interconnecting said camming surfaces and the side members, whereby said abrupt surfaces support a carton in the dispenser.

* * * * *